United States Patent [19]

Porper

[11] 4,137,593

[45] Feb. 6, 1979

[54] TOOTHBRUSH AND METHOD OF MAKING THE SAME

[76] Inventor: Robert P. Porper, 301 E. 87th St., New York, N.Y. 10028

[21] Appl. No.: 806,329

[22] Filed: Jun. 13, 1977

[51] Int. Cl.[2] ..... A46B 9/04

[52] U.S. Cl. ..... 15/167 A

[58] Field of Search ..... 15/167 A, 167 R, 171, 15/176; D4/25

[56] References Cited

U.S. PATENT DOCUMENTS

| | | | |
|---|---|---|---|
| 1,421,199 | 6/1922 | Field | 15/167 A |
| 2,093,383 | 9/1937 | Rudof | 15/176 X |
| 2,807,820 | 10/1957 | Dinbofer | 15/167 R X |

FOREIGN PATENT DOCUMENTS

| | | | |
|---|---|---|---|
| 212559 | 1/1958 | Australia | 15/167 A |
| 332091 | 10/1958 | Switzerland | 15/167 A |

*Primary Examiner*—Edward J. McCarthy

*Attorney, Agent, or Firm*—Lackenbach, Lilling & Siegel

[57] ABSTRACT

A toothbrush and the method of making the same are described which make it possible to produce a toothbrush, having a generally V-shaped head and bristles directed inwardly towards each other at a predetermined angle, in a simple and economical manner. The method involves forming separate and distinct bristle supporting pads which are fixedly mounted on the planar surfaces formed on a V-shaped head portion of the toothbrush. The bristle supporting pads may be at least partially received within recesses on the head portion surfaces and secured thereto by adhesive or other conventional means.

9 Claims, 5 Drawing Figures

TOOTHBRUSH AND METHOD OF MAKING THE SAME

BACKGROUND OF THE INVENTION

The present invention generally relates to the art of toothbrushes, and more specifically to a toothbrush which can effectively clean three exposed surfaces of the teeth simultaneously, and the method of making such toothbrushes.

There have been proposed numerous toothbrushes which are intended to provide cleaning surfaces that conform to the shape of the teeth. The object of all of these toothbrushes is to permit effective cleaning of all three exposed surfaces of the teeth simultaneously, namely the labial, lingual or palatal, and cutting and masticating surfaces. While many proposed solutions have been offered, very few have been implemented either because they are not commercially feasible, or impractical in their use.

There have been known, for example, toothbrushes which are provided with V-shaped heads providing two generally planar surfaces which form therebetween a predetermined angle of less than 180°. The bristles are mounted on these surfaces and are directed inwardly towards each other at a predetermined angle. Typical constructions of this type are shown and described in the following patents: French Pat. No. 1,164,294; Australian Pat. No. 212,559; French Pat. No. 707,843; British Pat. No. 366,382; Swiss Pat. No. 150,573; and U.S. Pat. Nos. 569,870 and 2,807,820. Similar toothbrushes having cylindrical or square configurations, instead of V-shaped head portions, are shown and described in U.S. Pat. Nos. 1,118,156; 2,077,392; and 2,090,663. However, the aforementioned toothbrushes have not been practical to manufacture because of the difficulty in molding the brush in its final configuration with the bristles in place. Heretofore, when molding a brush with the bristles in place, it was necessary to mold the brush in a flat shape and a secondary operation was required in order to curve the head portion so as to bring the two bristle sections into opposing position. Thus, while two-headed brushes have long been known in the art, their commercial exploitations have been unsuccessful.

Other toothbrushes have been proposed which suggest the use of removable bristle elements from the main toothbrush body or support member. For example, in U.S. Pat. No. 1,189,505, a toothbrush is described wherein the opposing bristle pads are disposed on opposite sides of each other and the bristles are oriented parallel to each other. The configuration and the size of the toothbrush disclosed as well as the other complexities inherent in the toothbrush make it extremely impractical, expensive and inconvenient to use. Removable bristle pads or elements are also disclosed in U.S. Pat. Nos. 2,674,000; 2,622,260; and 2,323,623. These last three mentioned patents disclose conventional toothbrushes with removable bristle pad elements, although U.S. Pat. No. 2,674,000 further includes means for dispensing toothpaste. Removable brush elements are also disclosed in U.S. Pat. Nos. 2,093,383 and 2,736,917, the first mentioned patent disclosing a generally U-shaped head portion with removable lateral sides. However, the above-described toothbrushes which have removable bristle elements are generally complex in construction and, therefore, expensive to manufacture. Additionally, toothbrushes having V-shaped head portions have not been provided with removable bristle pads and, for reasons stated above, have not been commercially exploited.

Other miscellaneous toothbrush constructions are described in U.S. Pat. Nos. 1,830,995; 1,976,271; 2,232,269; and 2,685,703. However, none of these last mentioned patents nor the patents mentioned above describe or suggest a toothbrush with a generally V-shaped head portion which is practical to use, and simple and economical to manufacture.

SUMMARY OF THE INVENTION

Accordingly, it is an object of the present invention to provide a toothbrush and a method for forming the same which do not have the disadvantages inherent in prior art toothbrushes and methods.

It is another object of the present invention to provide a toothbrush which is simple in construction and economical to manufacture.

It is still another object of the present invention to provide a toothbrush which has a generally V-shaped head portion having planar surfaces, and separately formed bristle supporting pads fixedly mounted on such surfaces.

It is yet a further object of the present invention to provide a method for producing toothbrushes of the type above suggested.

It is a further object of the present invention to provide a method of producing toothbrushes which includes separately molding a toothbrush supporting member which has a handle portion and a head portion of generally V-shaped configuration, and molding bristle supporting pads which are fixedly mounted on surfaces of the head portion.

In order to achieve the above objects, as well as others which will become apparent from the description that follows, a toothbrush in accordance with the present invention comprises an elongate handle portion and a head portion at one end of said handle portion. Said handle portion has two generally planar surfaces defining therebetween a first predetermined angle less than 180° to form a generally V-shaped space. Two bristle supporting pads are each fixedly mounted on one of the surfaces to direct the bristles on the pads inwardly into the V-shaped space and towards each other at a second predetermined angle therebetween.

In accordance with the presently preferred embodiment, each surface on said head portion is provided with a recess configurated and dimensioned to at least partially receive one of the bristle supporting pads. The bristle supporting pads may either be fixedly connected to the head portion surfaces by means of adhesive, or snap fastener means, or other conventional means.

The method of the present invention includes the steps of forming a supporting member which includes an elongate handle portion and a head portion at one end of said handle portion. Said head portion has two generally planar surfaces defining therebetween a first predetermined angle less than 180° to form a generally V-shaped space. Bristle supporting pads are formed separately and distinctly from the supporting member, and the bristle supporting pads are subsequently fixedly mounted on each of the planar surfaces of the head portion to direct the bristles on the pads into the V-shaped space and towards each other at a second predetermined angle therebetween.

In accordance with the presently preferred method, the supporting member as well as the bristle supporting pads are each separately injection molded. The bristle ends are advantageously cut and ground prior to attachment of the bristle supporting pads to the head portion to form substantially planar application surfaces. Advantageously, the head portion is molded to provide recesses in the planar surfaces, the recesses being configurated and dimensioned to at least partially receive one of the bristle supporting pads therein.

BRIEF DESCRIPTION OF THE DRAWINGS

Further advantages of the invention will become apparent from a reading of the following specification describing illustrative embodiments of the invention. This specification is to be taken with the accompanying drawings in which.

DESCRIPTION OF THE PREFERRED EMBODIMENT

Figure 1:
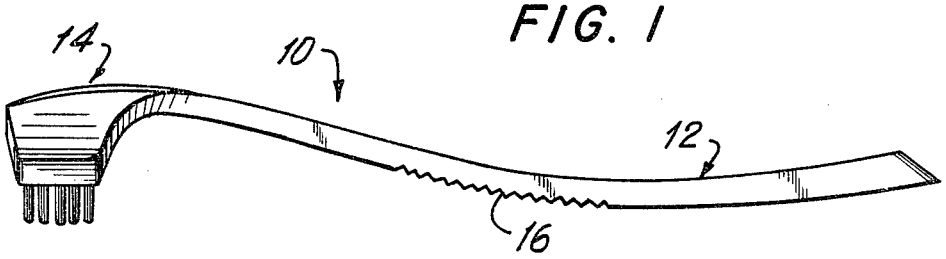
FIG. 1 is a side elevational view of the toothbrush in accordance with the present invention.
Figure 2:
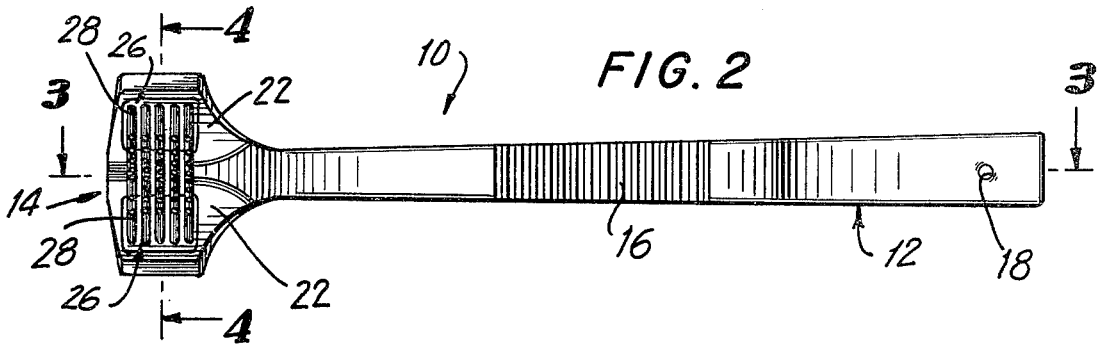
FIG. 2 is a front elevational view of the toothbrush shown in FIG. 1.
Figure 3:
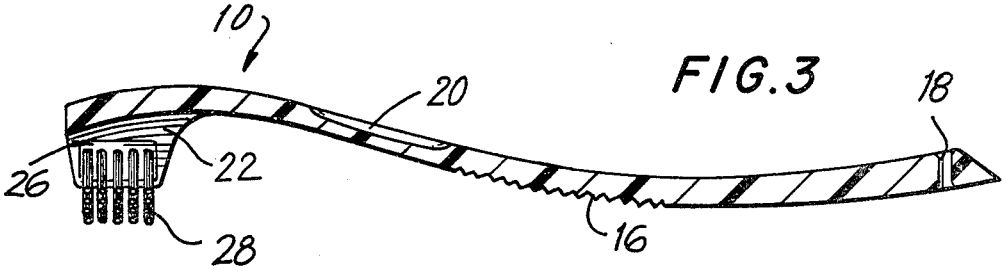
FIG. 3 is a longitudinal cross-section of the toothbrush shown in FIG. 2, taken along line 3—3.

Referring now to the Figures, in which similar or identical parts are designated by the same reference numerals throughout, and first referring to FIGS. 1—3, there is shown a toothbrush in accordance with the present invention designated by the reference numeral 10.

The toothbrush 10 has a supporting member which includes an elongate handle portion 12 and a head portion 14. Advantageously, the handle portion 12 is provided with a gripping surface 16 which is shown to be provided with a serrated or ribbed surface in the nature of a series of triangular grooves. However, any other gripping or friction producing surface may be used.

The toothbrush 10 is also provided with a hole 18 which may be dimensioned to receive a toothpick or other cleaning implement for cleaning hard-ro-reach teeth or for interproximal cleansing and stimulation, and is shown to be provided with a longitudinal ornamental groove 20 on the outer surface of the handle portion 12.

Figure 4:
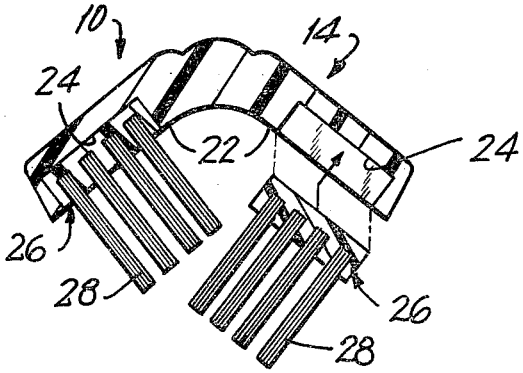
FIG. 4 is an enlarged cross-sectional view of the head portion of the toothbrush shown in FIG. 2, taken along line 4—4, and showing one of the bristle supporting pads received within a recess of the head portion, and another bristle supporting pad in the process of being inserted within such a recess.
Figure 5:
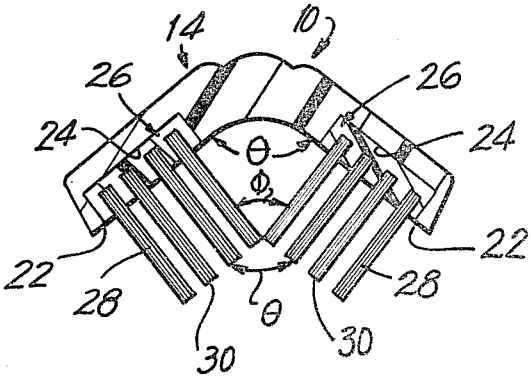
FIG. 5 is similar to FIG. 4, but showing both bristle supporting pads received within their associated recesses, and showing some dimensional relationships of the assembled toothbrush.

Referring also to FIGS. 4 and 5, the head portion 14 is shown to be provided with two generally planar surfaces 22 defining therebetween a first predetermined angle $\theta$ less than 180° to form a generally V-shaped space.

An important feature of the present invention is that bristle pads 26 which support bristles 28 formed separately and distinctly from the handle portion 12 or the head portion 14. The pads 26 are subsequently fixedly mounted on each of the planar surfaces 22 to direct the bristles 28 on the pads 26 into the V-shaped space and towards each other at a second predetermined angle $\phi$ therebetween. While the pads 26 can be secured in any conventional manner to the planar surfaces 22, the pads are advantageously received within recesses 24 which are configurated and dimensioned to at least partially receive one of the bristle supporting pads 26. In the presently preferred embodiments, the pads 26 are received within the recesses 24 as shown in FIG. 4 and are fixedly secured therein by means of any suitable adhesive. However, it will become evident to one skilled in the art that other means of mounting the bristle pads 26 on the head portion 14 are possible, including using snap fastener means either directly on the surfaces 22 or within the recesses 24.

With the method of the present invention, the bristles 28 may be tufted on the bristle pads 26 by conventional bristle machines. The bristles may be made, for example, from Nylon 612 (Dupont Zytel 158L NC-10).

The toothbrush supporting member which includes the handle portion 12 and head portion 14 may be formed by injection molding. However, with the method of the present invention, the head portion 14 need not be bent or otherwise deformed in a subsequent operation as was the case with conventional prior art toothbrushes. Now, the head portion 14 may be molded in a desired shape or configuration, without consideration of the bristle tufting operation. The bristle pads 26 are independently molded in a simple and conventional manner and are subsequently cemented or otherwise attached to the head portion 14 as suggested in FIG. 4.

The bristles 28 are advantageously cut and ground at the free ends thereof after being mounted on the pads 26 to form substantially planar application surfaces 30 as shown in FIG. 5.

The handle portion 12 and head portion 14 may be molded from a material such as Styrene-Acrylonitrile, and the brush base or pad 26 may also be molded from this same material.

The surfaces 22 of the head portion 14 are generally planar as described, and the angle $\theta$ is taken about a line generally parallel to the longitudinal length direction of the handle portion 12.

The bristles 28 on the pads 26 are directed substantially normally to the head portion surfaces 22. With this arrangement, the angle $\phi$ between the opposing bristles 28 is supplemental to the angle $\theta$ of the head portion surfaces 22.

The application surfaces 30 formed by the bristles 28 on the two pads are parallel to the associated head portion surfaces 22 and define therebetween the angle $\theta$, and as best shown in FIG. 5, the pads 28 have the ends thereof proximate to each other to form a substantially continuous application surface resulting from the contiguous or proximate positions of the opposing application surfaces 30.

The above-described toothbrush achieves the objects of the present invention in a simple and economical manner and makes hitherto proposed toothbrushes of the type adapted to simultaneously act upon two or more tooth surfaces practical.

It is to be understood that the foregoing description of the preferred embodiment illustrated herein is exemplary and various modifications to the embodiment shown herein may be made without departing from the spirit and scope of the invention.

What is claimed is:

1. A toothbrush comprising an elongate handle portion and a head portion at one end of said handle portion, said head portion having two generally planar surfaces defining therebetween a first predetermined angle less than 180° to form a generally V-shaped space; and two bristle supporting pads each fixedly mounted on one of said surfaces to direct the bristles on said pads inwardly into said V-shaped space and towards each other at a second predetermined angle therebetween.

2. A toothbrush as defined in claim 1, wherein each surface of said head portion is provided with a recess configurated and dimensioned to at least partially receive on of said bristle supporting pads.

3. A toothbrush as defined in claim 2, further comprising adhesive means for fixedly connecting said bristle supporting pads within said recesses.

4. A toothbrush as defined in claim 1, wherein said bristle supporting pads are snap mounted on said surfaces.

5. A toothbrush as defined in claim 1, wherein said bristles on said pads are directed substantially normally to said head portion surfaces.

6. A toothbrush as defined in claim 5, wherein said second predetermined angle is supplemental to said first predetermined angle.

7. A toothbrush as defined in claim 1, wherein the lengths of the bristles on each pad are substantially equal to form substantially planar application surfaces.

8. A toothbrush as defined in claim 7, wherein said application surfaces formed by the bristles on said two pads are parallel to the associated head portion surfaces and define therebetween said first predetermined angle.

9. A toothbrush as defined in claim 8, wherein the innermost bristles on said pads have the ends thereof proximate to each other to form a substantially continuous application surface.

* * * * *